United States Patent [19]

Suwa et al.

[11] Patent Number: 4,569,479

[45] Date of Patent: Feb. 11, 1986

[54] BURNER FOR POWDER SPRAY COATING

[75] Inventors: Toshio Suwa, Tokyo; Yoshiaki Konagaya, Yokohama, both of Japan

[73] Assignee: Nippon Sanso K.K., Japan

[21] Appl. No.: 595,344

[22] Filed: Mar. 30, 1984

Related U.S. Application Data

[63] Continuation of Ser. No. 121,739, Feb. 15, 1980, abandoned.

[30] Foreign Application Priority Data

Feb. 21, 1979 [JP] Japan ..... 54-19445
Feb. 21, 1979 [JP] Japan ..... 54-19446
Feb. 21, 1979 [JP] Japan ..... 54-19447

[51] Int. Cl.[4] ..... B05B 7/20
[52] U.S. Cl. ..... 239/79; 239/85
[58] Field of Search ..... 239/79–85, 239/419

[56] References Cited

U.S. PATENT DOCUMENTS 2,317,173 4/1943 Bleakley ..... 239/85
2,613,737 10/1952 Schwietert ..... 239/419
3,253,783 5/1966 Probst et al. ..... 239/85

*Primary Examiner*—Andres Kashnikow
*Assistant Examiner*—James R. Moon, Jr.
*Attorney, Agent, or Firm*—Kane, Dalsimer, Kane, Sullivan and Kurucz

[57] ABSTRACT

A burner for flame-spray coating, being capable of sufficiently high flame temperature and being capable to flame-spray powder material of high melting point by using such fuel gas as $C_3H_8$ or $C_4H_{10}$ with high efficiency of deposition, having a gas-powder stream supplying conduit connectedly arranged at the rear portion of a pre-mix combustion chamber, from where gas-powder stream being jetted into the chamber, characterized that at least a series of auxiliary combustion gas (oxygen, oxygen enriched air) supplying passages are annularly provided on the conical wall face of said chamber with the direction of converging toward an opening for flame jet and the axis of the pre-mix combustion chamber.

16 Claims, 7 Drawing Figures

BURNER FOR POWDER SPRAY COATING

This is a continuation of application Ser. No. 121,739 filed Feb. 15, 1980, now abandoned.

BACKGROUND OF THE INVENTION

The present invention relates to a burner for powder spray coating.

Conventional type of burners were could not create sufficiently high flame temperatures when fuel gas such as $C_3H_8$ or $C_4H_{10}$ and the like was utilized and therefore could not flame-spray the powder material of high melting points, such as ceramics, for example, $Al_2O_3$. When necessity should arise to flame-spray powder materials of high melting points, $C_2H_2$ was utilized as fuel gas in general. However, since $C_2H_2$ has a nature of self-decomposition, it was necessary to keep low supplying pressure, thus making it inadequate to utilize for a job requiring of large quantities of fuel.

SUMMARY OF THE INVENTION

The present invention provides a burner for powder spray coating which is capable of creating sufficiently high flame temperatures by utilizing afore-mentioned $C_3H_8$, $C_4H_{10}$ or the like as fuel gas and which therefore is capable of flame-spraying such powder material of high melting points as ceramics with high deposition efficiency. Another object of the invention is to provide a burner for large scale flame-spray coating.

More particularly, the powder spraying burner according to this invention is so constructed that it is capable of completely mixing gas-powder stream, which is formed by mixture of fuel gas and powder material, with auxiliary combustion gas (oxygen or oxygen enriched air) and of gathering the powder material contained in the gas-powder stream in the center of flame. Three embodiments herein presented have common features in order to obtain the above-mentioned effects. Namely, the powder spraying burner of the present invention comprises a pre-mix combustion chamber, an opening for flame jet positioned at the front end of said pre-mix combustion chamber and a gas-powder stream supplying conduit connectedly positioned at the rear end of said chamber from where the gas-powder stream is jetted into the chamber, and at least a series of auxiliary combustion gas supplying passages are annularly provided in the wall of said chamber, and said series of auxiliary combustion gas supplying passages are provided by piercing with direction to converge to the axis of the pre-mix combustion chamber and the opening for flame jet which is positioned at forward end.

DETAILED DESCRIPTION OF THE PREFERRED EMBODIMENTS

Figures 1, 2:
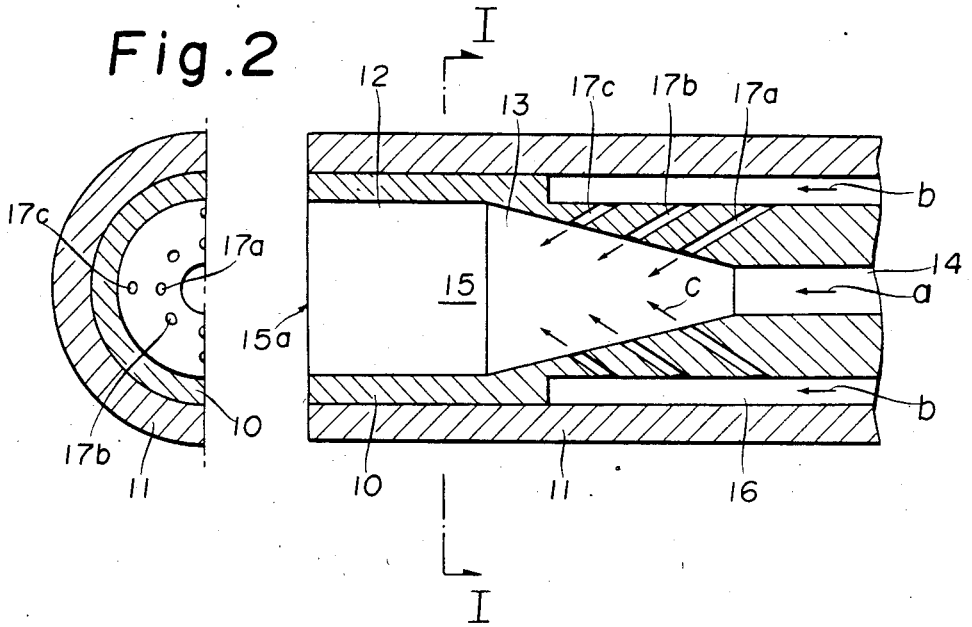
FIG. 1 is a longitudinal sectional view representing the first embodiment of the invention.
FIG. 2 is a cross sectional view taken along line I—I of FIG. 1.

Detailed description on the first embodiment will be given hereunder. FIGS. 1 and 2 show the first embodiment of the invention. In FIGS. 1 and 2, a cylindrical shaped outer sleeve 11 is circumferentially fixed to a copper inner sleeve 10. The inner sleeve 10 has a columnar shaped hollow 12, a truncated conical shaped hollow 13 and a gas-powder stream supplying conduit 14 which is formed by a columnar shaped hollow with a smaller diameter than that of said hollow 12. Said hollows 12 and 13 combinedly form a pre-mix combustion chamber 15, the front end of which is opened as an opening for flame jet 15*a*. The opposite end portion of the pre-mix combustion chamber is connected to said gas-powder stream supplying conduit 14. The gas-powder stream is taken into the pre-mix combustion chamber 15 through the gas-powder supplying conduit 14, form flame therein and thereafter flame jetted out of the opening for flame jet 15*a*.

The outer diameter of the inner sleeve 10 at the portion of said chamber 15 is equal to the inner diameter of the outer sleeve 11 and the outer periphery of the inner sleeve 10 is intimately connected with the inner periphery of the outer sleeve 11 at the portion of the pre-mix combustion chamber 15. On the other hand, the outer diameter of the inner sleeve 10 at the portion of the gas-powder stream supplying conduit 14 is smaller than the inner diameter of the outer sleeve 11 and at the portion outside of the gas-powder stream supplying conduit 14, an annularly vacant space is configured between the outer periphery of the inner sleeve 10 and the inner periphery of the outer sleeve 11. This vacant space configures the auxiliary combustion gas guide passage 16. The wall of the truncated conical shaped hollow 13 which defines a part of the pre-mix combustion chamber has openings of three series of auxiliary combustion gas supplying passages 17*a*, 17*b*, 17*c* which are in the shape of small channel at each position along the generatrix of the conical wall face. Each series of the auxiliary combustion gas supplying passages consists of four or more individual auxiliary combustion gas supplying passages annularly arranged in the plane normal to the axis of said chamber 15. These passages 17*a*, 17*b*, 17*c* are provided by drilling from the auxiliary combustion gas guide passage 16 till the pre-mix combustion chamber 15 with the direction of convergence toward the opening for flame jet and along the axis. These auxiliary combustion gas supplying passages may be replaced with annular slits.

In this way, auxiliary combustion gas is supplied into the pre-mix combustion chamber through the auxiliary combustion gas guide passage 16 and via the auxiliary combustion gas supplying passages 17*a*, 17*b*, 17*c* and is mixed with the aforementioned gas-powder stream therein.

Function of such constructed powder spraying burner as mentioned above will be next described.

In FIGS. 1 and 2, powder material $Al_2O_3$ is carried by fuel gas $C_3H_8$ and introduced through the gas-powder stream supplying conduit 14 to the direction of arrow a at the velocity of approximately 20 m/sec as gas-powder stream and jetted into the pre-mix combustion chamber. While auxiliary combustion gas is introduced through the auxiliary combustion gas guide passage 16 in the direction of arrow b at the velocity of approximately 20 m/sec and is jetted into the pre-mix combustion chamber 15 to the direction of arrow c at the velocity of approx. 150 m/sec via the auxiliary combustion gas supplying passages 17*a*, 17*b*, 17*c*. As a result, fuel gas and auxiliary combustion gas are completely mixed each other without scattering powder.

Specifically, since the auxiliary combustion gas supplying passages 17*a*, 17*b*, 17*c* are arranged at different positions along the generatrix respectively, the aforementioned gas-powder stream passes by the passages 17*a* first, then by the passages 17*b*, 17*c* one after another. Consequently, the gas-powder stream is firstly mixed with auxiliary combustion gas jetted out of the passages 17*a* and then with that of the passages 17*b*, 17*c* one after another. In this case, since each auxiliary combustion gas supplying passage 17*a*, 17*b*, 17*c* is drilled with the direction of convergence toward the opening for flame jet 15*a* along said axis, smooth supply of gas-powder stream out of the gas-powder stream supplying conduit 14 is not disturbed by jet of auxiliary cmbustion gas.

In this way, gas-powder stream is supplied smoothly and this gas-powder stream is completely mixed with auxiliary combustion gas. As a result, high flame temperature zone is created in the area from the pre-mix combustion chamber 15 to the outer area of the opening for flame jet 15*a*. Therefore, even if powder material included in the gas-powder stream is that of high melting points, it is completely melted throughout the zone from the outer area of the opening for flame jet 15*a*. The velocity of gas jetted out of the opening for flame jet 15*a* is approximately 250 m/sec and that of mostly melted powder material is at approximately 150 m/sec. Powder material is jetted out of the opening for flame jet 15*a* and after completely melted in the flame deposited on an object (not shown) to be coated.

The auxiliary combustion gas supplying passages 17*a* are annularly arranged at the conical face of the pre-mix combustion chamber and provided with the direction of convergence to the opening for flame jet 15*a* and along the axis, and auxiliary combustion gas supplying passages 17*b*, 17*c* are likewise provided at the conical face of the pre-mix combustion chamber 15. Therefore, powder material included in the gas-powder stream is not scattered and powder material included in the gas-powder stream is gathered towards the center of flame, i.e., along the axis of the pre-mix combustion chamber 15. As a result, it is capable of spraying with high deposition efficiency. According to the experiment (I) of flame-spray coating by utilizing the above burner for spray coating, significantly high deposition efficiency was obtained as shown in Table 1 by using $C_3H_8$ and $Al_2O_3$ (pure) as fuel gas and powder material respectively.

TABLE 1

| Experiment (I) of Flame Spray Coating | |
|---|---|
| $C_3H_8$ Supplying quantity | 100 ($Nm^3/H$) |
| $O_2$ Supplying quantity | 500 ($Nm^3/H$) |
| Powder material | $Al_2O_3$ (100%) |
| Deposition quantity | 3.2 ($KgAl_2O_3/Nm^3C_3H_8$) |
| Deposition efficiency | 89% |

In the above experiment, powder material was carried by fuel gas, but it may be carried by mixture of fuel gas and auxiliary combustion gas.

Figure 3:
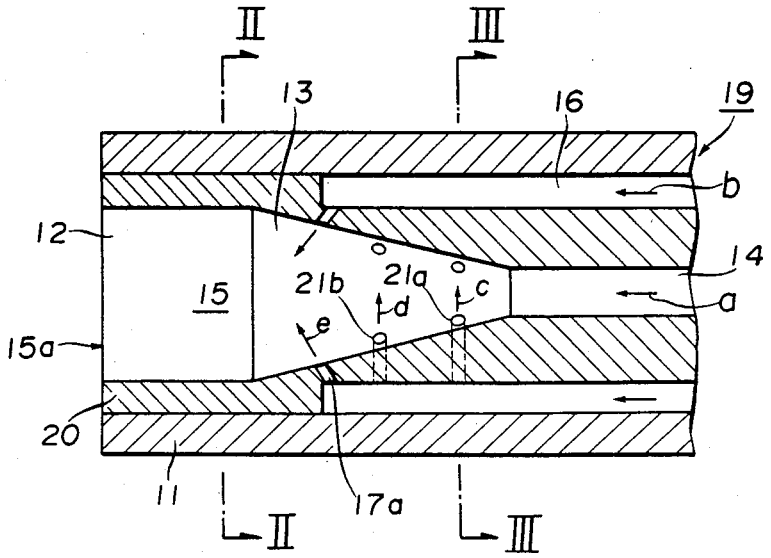
FIG. 3 is a longitudinal sectional view representing the second embodiment of the invention.
Figure 4:
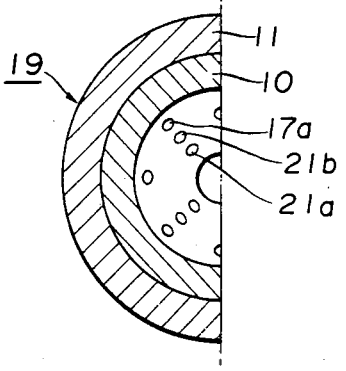
FIG. 4 is a cross sectional view taken along line II—II of FIG. 3.
Figure 5:
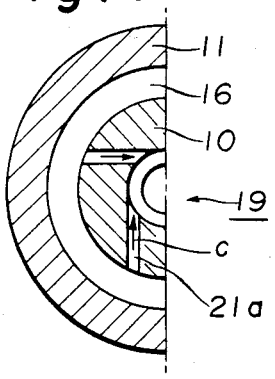
FIG. 5 is a cross sectional view taken along line III—III of FIG. 3.

The second embodiment of the invention will be next described. FIGS. 3, 4 and 5 represent a burner body 19 of this embodiment. In FIGS. 3, 4 and 5, a cylindrical shaped outer sleeve 11 is circumferentially fixed on a copper inner sleeve 20. The inner sleeve 20 has a columnar shaped hollow 12, a truncated conical shaped hollow 13 and a gas-powder stream supplying conduit 14 configured by a columnar shaped hollow with a smaller diameter than that of said hollow 12. Said hollow 12 and 13 combinedly form a pre-mix combustion chamber 15, front end of it is opened as an opening for flame jet 15*a*. The opposite end portion of the pre-mix combustion chamber 15 is connected to said gas-powder stream supplying conduit 14. The gas-powder stream is introduced into the pre-mix combustion chamber 15 through the gas-powder supplying conduit 14, form flame, and then flame jetted out of the opening for flame jet 15*a*.

The outer diameter of the inner sleeve 20 at the portion of said chamber 15 is equal to the inner diameter of the outer sleeve 11 and the outer periphery of the inner sleeve 20 is intimately connected with the inner periphery of the outer sleeve 11 at the portion of the pre-mix combustion chamber 15. On the other hand, the outer diameter of the inner sleeve 20 at the portion of the gas-powder stream supplying conduit 14 is smaller than the inner diameter of the outer sleeve 11 and at the portion outside the gas-powder stream supplying conduit 14, an annular vacant space is configured between the outer periphery of the inner sleeve 20 and the inner periphery of the outer sleeve 11. This annular vacant space configures the auxiliary combustion gas guide passage 16.

The wall (conical face) of the hollow 13 which defines a part of the pre-mix combustion chamber 15 has openings of two series of auxiliary combustion gas sub-supplying passages 21*a*, 21*b*, which are in the shape of small channel, at every two different position along the generatrix of the conical face and each series of auxiliary combustion gas sub-supplying passages consists of four sub-supplying passages respectively which are provided in annularly arrangement. These sub-supplying passages 21*a*, 21*b* are drilled from said auxiliary combustion gas guide passage 16 till said pre-mix combustion chamber 15 in a direction tangent to the wall (conical face) of said hollow 13. The wall (conical face) of said hollow 13 of said chamber 15 also has a series of auxiliary combustion gas supplying passages 17*a*, which consists of 8 passages, located closer to the hollow 12 than the aforementioned two different positions along the generatrix of the conical face. These auxiliary combustion gas supplying passages 17*a* are provided by drilling with direction of convergence toward the opening of flame jet 15*a* and along the axis of the pre-mix combustion chamber 15 from the auxiliary combustion gas guide passage 16 till the pre-mix combustion chamber 15. These auxiliary combustion gas supplying passages 17*a* may be substituted for an annular slit or slits. Further, these auxiliary combustion gas supplying passages 17*a* may be arranged in a plurality of series in the longitudinal direction on the wall of said chamber 15.

In this way, auxiliary combustion gas is supplied into the pre-mix combustion chamber 15 through auxiliary combustion gas guide passage 16 and via the auxiliary combustion gas sub-supplying passages 21*a*, 21*b* and auxiliary combustion gas supplying passages 17*c*, and mixed with said gas-powder stream in the chamber 15.

The function of burners so constructed in accordance with the present invention is be described in FIGS. 3, 4 and 5, powder material $Al_2O_3$ is carried by fuel gas $C_3H_8$ and introduced into the gas-powder stream supplying conduit 14 as per the arrow a at a velocity of approximately 20 m/sec as gas-powder stream and jetted into the pre-mix combustion chamber 15. While the auxiliary combustion gas is introduced into the auxiliary combustion gas guide passage 16 at a velocity of approximately 20 m/sec as per the arrow b and jetted into the pre-mix combustion chamber 15 through the auxiliary combustion gas sub-supplying passages 21*a*, 21*b* and the auxiliary combustion gas supplying passages 17*a* at the velocity of approximately 150 m/sec as per the arrows c, d and e. As a result, the fuel gas and the auxiliary combustion gas are mixed each other.

More specifically, since the auxiliary combustion gas sub-supplying passages 21*a*, 21*b* and combustion gas supplying passages 17*a* are arranged at different positions of the generatrix respectively, the aforementioned gas-powder stream passes by the passages 21*a* first, then by 21*b*, 17*a* one after another. Consequently, the gas-powder stream is first mixed with the auxiliary combustion gas jetted out of the passages 21*a* and then with that of the passages 21*b*, 17*a* one after another. In this case, since each auxiliary combustion gas sub-supplying passages 21*a*, 21*b* is provided with the direction tangent to the conical face of the hollow 13 of the chamber 15 and each auxiliary combustion gas supplying passage 17*a* is provided with the direction of convergence towards the opening for flame jet 15*a* and the axis of the chamber 15, the smooth supply of gas-powder stream out of the gas-powder stream supplying conduit 14 is not disturbed by jet of auxiliary combustion gas.

In this way, gas-powder stream is supplied smoothly and this gas-powder stream is completely mixed with auxiliary combustion gas. As a result, a high flame temperature zone is created in the area from the pre-mix combustion chamber 15 till outer area of the opening of flame jet 15*a*. Therefore, even if the powder material included in the gas-powder stream is that of high melting points, it is completely melted in the zone betweeen gas-powder stream supplying conduit 14 and the outer area of the opening of flame jet 15*a*. The velocity of gas flame jetted out of the opening of flame jet 15*a* is approximately 250 m/sec and that of the mostly melted powder material is at approximately 150 m/sec. Powder material is jetted out of the opening of flame jet 15*a* at this velocity and after completely melted in the flame deposited on an object (not shown) to be coated.

The auxiliary combustion gas sub-supplying passages 21*a* are annularly arranged at the conical face of the pre-mix combustion chamber and configured by drilling in the direction tangent to said conical face. The auxiliary combustion gas sub-supplying passages 21*b* are likewise arranged at the pre-mix combustion chamber 15. Further, the auxiliary combustion gas sub-supplying passages 17*a* are annularly arranged at the conical face of the pre-mix combustion chamber 15 and configured by drilling with the direction convergence toward the opening of flame jet 15*a* and along the axis of the chamber 15.

Therefore, powder material included in the gas-powder stream is not scattered and powder material included in the gas-powder stream is gathered towards the center of flame, i.e., along the axis of the pre-mix combustion chamber 15. As a result, flame-spray coating with high deposition efficiency is attained. According to the experiment (II) of flame-spray coating by utilizing the above burner for powder spray coating, significantly high deposition efficiency was obtained as shown in Table 2 by using $C_3H_8$ and $Al_2O_3$ (pure) as fuel gas and powder material respectively.

TABLE 2

| Experiment (II) of Flame-Spray coating | |
|---|---|
| $C_3H_8$ Supplying quantity | 100 ($Nm^3/H$) |
| $O_2$ Supplying quantity | 500 ($Nm^3/H$) |
| Powder material | $Al_2O_3$ (100%) |
| Deposition quantity | 2.7 (Kg $Al_2O_3/Nm^3C_3H_8$) |
| Deposition efficiency | 87% |

In the above experiment, powder material was carried by fuel gas, but as seen from the above experiment (I) it may be carried by mixture of fuel gas and auxiliary combustion gas.

Figure 6:
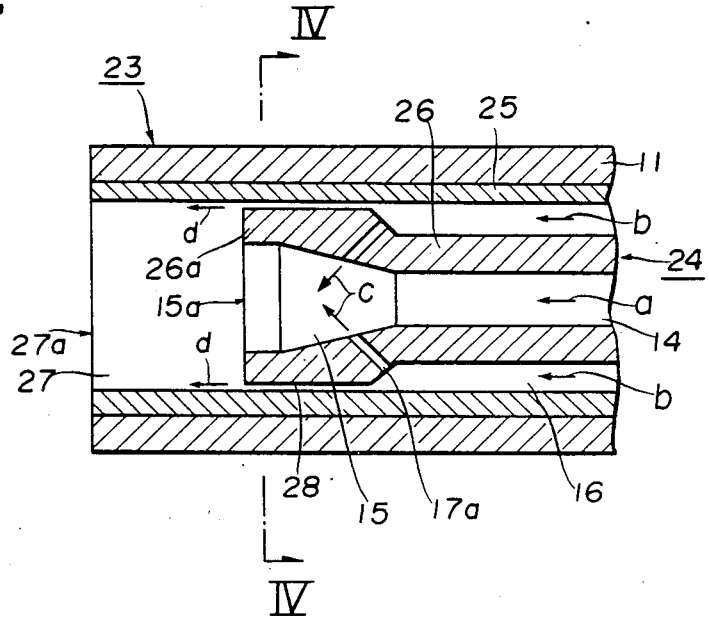
FIG. 6 is a longitudinal sectional view representing the third embodiment of the invention.
Figure 7:
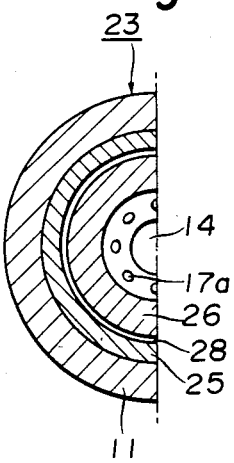
FIG. 7 is a cross sectional view taken along line IV—IV if FIG. 6.

Detailed description on the third embodiment will be given next. FIGS. 6 and 7 show the burner body 23 for flame-spray coating according to the third embodiment of the invention. In FIGS. 6 and 7, this burner body 23 consists of an inner sleeve 24 and an outer sleeve 11. The inner sleeve 24 has a first copper inner shell 25 and a second copper inner shell 26. These first and second inner shells 25 and 26 configure a first pre-mix combustion chamber 15, a second pre-mix combustion chamber 27, a gas-powder stream supplying conduit 14, an auxiliary combustion gas guide passage 16, plurality of auxiliary combustion gas supplying passages 17*a* (8 pcs in this embodiment) and auxiliary combustion gas sub-supplying passages 28.

The outer sleeve 11 and the first inner shell 25 are cylindrical shaped and the second inner shell 26 is almost cylindrical shaped. Said outer sleeve 11, first inner shell 25 and second inner shell 26 are coaxially arranged. The outer sleeve 11 is circumambiently provided on the first inner shell 25. The second inner shell 26 is smaller than the first inner shell 25 in diameter and is arranged to fix in the first shell 25.

The front portion of the first inner shell 25 is opened as an opening for flame jet 27*a*. The front face 26*a* of the second inner shell 26 is backwardly located from the opening for flame jet 27*a* at a predetermined length. As a result, a columnar shaped second pre-mix combustion chamber 27 is configured by the first inner shell 25 and the front end portion 26*a* of the second inner shell 26. An circle shaped opening 15*a* is provided at the end portion 26*a* of the second inner shell 26. The second inner shell 26 has a truncated conical shaped first pre-mix combustion chamber 15 which is connected to the opening 15*a*. A gas-powder stream supplying conduit 14 which has columnar shaped hollow is connectedly arranged at the opposite end portion for the opening 15*a* of said first pre-mix combustion chamber.

In this way, gas-powder stream is introduced through the gas-powder stream supplying conduit 14 into the first pre-mix combustion chamber 15 and then into the second pre-mix combustion chamber 27 one after another. The gas-powder stream is thereafter ignited and jetted out of the opening for flame jet 27*a*.

The outer diameter of the second inner shell 26 is a little smaller than the inner diameter of the first inner shell 25 at the portion of outside of first pre-mix combustion chamber 15. Consequently, an auxiliary combustion gas sub-supplying passage 28 of an annularly shaped slit is formed. While, the outer diameter of the second inner shell 26 is considerably smaller than the inner diameter of the first inner shell 25, at the portion of outside of the gas-powder stream supplying conduit 14. Consequently, an annularly shaped slit auxiliary combustion gas guide passage 16 is formed.

Further, the second inner shell 26 is provided with an auxiliary combustion gas supplying passages 17*a* between the first pre-mix combustion chamber 15 and the auxiliary combustion gas guide passage 16. These auxiliary combustion gas supplying passages 17*a* are annularly arranged in the conical wall face of the first pre-mix combustion chamber 15 and drilled with the direction of convergence toward the opening 15*a* of said pre-mix combustion chamber 15 and along the axis of the burner body. Although FIGS. 6 and 7 show a series of auxiliary combustion gas supplying passages 17*a*, a plurality of series of said passages 17*a* may be provided in the longitudinal direction on the conical wall face of the chamber 15. Also, passages 17*a* may be substituted for by an annular shaped slit or slits. While, an auxiliary combustion gas sub-supplying passage 28 of an annular slit may be substituted for annularly arranged series of channels or holes of small diameter.

In this way, the auxiliary combustion gas, which is fed into the auxiliary combustion guide passage 16, is supplied into the first and second pre-mix combustion chambers 15 and 27 respectively through auxiliary combustion gas supplying passages 17*a* and auxiliary combustion gas sub-supplying passage 28, and then is mixed with said gas-powder stream therein.

Function of such constructed burner for powder spray coating as mentioned above will be next described. In FIGS. 6 and 7, powder material $Al_2O_3$ is carried by fuel gas $C_3H_8$ and introduced through the gas-powder stream supplying conduit 14 in the direction of arrow a at the velocity of approximately 20 m/sec as gas-powder stream. While auxiliary combustion gas is introduced through the auxiliary combustion gas guide passage 16 in the direction of arrow b at the velocity of approximately 20 m/sec. After passing through auxiliary combustion gas supplying passages 17*a* and auxiliary combustion gas sub-supplying passage 28 at the velocity of approximately 150 m/sec in the direction of arrows c and d, said auxiliary combustion gas is jetted into the first and second pre-mix combustion chambers 15 and 27. As a result, the fuel gas and the auxiliary combustion gas are mixed with each other.

More specifically, since auxiliary combustion gas passages 17*a* are connected to the first pre-mix combustion chamber 15 and since the auxiliary combustion gas sub-supplying passage 28 is connected to the second pre-mix combustion chamber 27, said gas-powder stream passes firstly by the passages 17*a*, and then by the passage 28. Consequently, the gas-powder stream is firstly mixed with the auxiliary combustion gas jetted out of the passages 17*a* and then with that of the passage 28. In this case, since each auxiliary combustion gas supplying passage 17*a* is facing towards the opening for flame jet 27*a* (the opening 15*a*), smooth supply of the gas-powder stream from the conduit 14 is not disturbed by each jet of said auxiliary combustion gas.

In this way, gas-powder stream is supplied smoothly and mixed completely with the auxiliary combustion gas. As a result, high flame temperature zone is created in the area from the first and second pre-mix combustion chambers 15 and 27 till outer area of the opening for flame jet 27*a*. Therefore, even if the powder material included in the gas-powder stream is that of high melting points, it is completely melted throughout the zone till outer area of the opening for flame jet. The velocity of gas (flame) jetted out of the opening for flame jet 27*a* is at approximately 250 m/sec and that of mostly melted powder material is at approximately 150 m/sec. Powder material is jetted out of the opening for flame jet 27*a* at this velocity and after completely melted in the flame it is deposited on an object (not shown) to be coated.

The auxiliary combustion gas supplying passages 17*a* are annularly arranged at the conical wall face of the first pre-mix combustion chamber 15 and provided with a direction of convergence toward the opening 15*a* (the opening for flame jet 27*a*) and along the axis of the burner. Further, the auxiliary combustion gas sub-supplying passage 28 is an annularly shaped slit facing towards the opening for flame jet 27*a*. As a result, powder material included in the gas-powder stream is prevented from scattering and gathered in the center of flame. (which is the direction of the axis, the first and second pre-mix combustion chamber 15 and 27) Consequently, flame spraying with high deposition efficiency is obtained. According to the experiment (III), of the flame-spray coating by utilizing the above burner for powder spray coating, significantly high deposition efficiency was obtained as shown in Table 3 by using $C_3H_8$ and $Al_2O_3$ (pure) as fuel gas and powder material respectively.

TABLE 3

| Experiment (III) of Flame-spray coating | |
|---|---|
| $C_3H_8$ Supplying quantity | 100 ($Nm^3/H$) |
| $O_2$ Supplying quantity | 500 ($Nm^3/H$) |
| Powder material | $Al_2O_3$ (100%) |
| Deposition quantity | 2.7 (Kg $Al_2O_3/Nm^3$ $C_3H_8$) |
| Deposition efficiency | 88% |

In the above experiment, powder material was carried by fuel gas, but it may be carried by mixture of fuel gas and auxiliary combustion gas as in the cases of the first two embodiments.

As explained above in each of the embodiments, the burner for powder spray coating according to this invention is capable of completely mixing gas-powder stream with auxiliary combustion gas, resulting in high flame temperatures. Moreover, since the burner is capable of gathering the powder material included in the gas-powder stream in the center of the flame, such fuel gas as $C_3H_8$ or $C_4H_{10}$ can be utilized to flame-spray the powder material of high melting points with high deposition efficiency.

What is claimed is:

1. A burner for powder spray coating, comprises:

a premix combustion chamber having a flame jet opening at its forward end;

a gas-powder stream supplying conduit communicating with said premix combustion chamber for permitting a gas-powder stream having an axis of flow in the conduit to enter the chamber;

said premix combustion chamber having a columnar portion at the forward end and a truncated conical portion tapering from said columnar portion into said gas-powder supplying conduit;

a wall of said premix combustion chamber defining a flow path; and means for supplying auxiliary gas provided in said wall including at least one series of auxiliary gas passages provided in said truncated conical portion and said wall; said passages being annularly disposed about the gas-powder stream axis of flow, said passages being oriented to direct auxiliary gas passing therethrough in a path converging on the flame jet opening and the gas-powder stream axis of flow.

2. A burner for powder spray coating, which comprises:

a pre-mix combustion chamber that includes a truncated conical premix portion and a columnar combustion portion having an opening for a flame jet defining its front end and a gas-powder stream supplying conduit connectedly positioned at said pre-mix portions rear end through which a gas-powder stream is jetted into said chamber, characterized by at least a series of auxiliary combustion gas supplying passages provided in an annular arrangement about the center axis of said chamber by piercing the wall of said truncated conical pre-mix portion in the direction of convergence toward said opening for a flame jet and along said axis.

3. A burner for powder spray coating according to claim 2, in which said series of auxiliary combustion gas supplying passages are small holes which are provided by penetrating the wall of said pre-mix portion with the direction of convergence toward the said opening for flame jet and along the said axis.

4. A burner for powder spray coating according to claim 2, in which said series of auxiliary combustion gas supplying passages are slits which are formed in the wall of said pre-mix portion with in a direction of convergence toward the said opening for flame jet and along the said axis.

5. A burner for powder spray coating according to claim 2, which is further characterized by a columnar shaped second pre-mix combustion chamber provided within said (first) pre-mix combustion chamber coaxial to axis of the burner and arranged from rear end to front end with auxiliary combustion gas sub-supplying passage arranged annularly about center axis on the wall of said second pre-mix combustion chamber and said auxiliary combustion gas sub-supplying passages are provided by piercing with the direction of the opening for flame jet.

6. A burner for powder spray coating according to claim 5, in which said auxiliary combustion gas sub-supplying passages are small holes extending in the direction of the opening for flame jet.

7. A burner for powder spray coating according according to claim 5, in which said auxiliary combustion gas sub-supplying passages are slits provided by arranging with the direction of opening for flame jet.

8. A burner for powder spray coating according to claim 2 further characterized by at least a series of auxiliary combustion gas sub-supplying passages arranged annularly about the center axis of said truncated conical pre-mix portion in a direction substantially tangent to a circular cross-section of taken along the inner wall of said pre-mix portion to communicate with said pre-mix combustion chamber.

9. A burner for powder spray coating according to claim 2, in which said gas-powder stream supplying conduit is a conduit for fuel gas and powder.

10. A burner for powder spray coating according to claim 2, in which said gas-powder stream supplying conduit is a conduit for fuel gas, powder, and oxygen.

11. A burner for powder spray coating according to claim 2, in which said gas-powder stream supplying conduit is a conduit for fuel gas, powder, and oxygen enriched air.

12. A burner for powder spray coating according to claim 2, in which said auxiliary combustion gas supplying passage is a passage for oxygen.

13. A burner for powder spray coating according to claim 2, in which said auxiliary combustion gas supplying passage is a passage of oxygen enriched air.

14. A burner for powder spray coating to claim 9, said fuel gas is selected from the group consisting of propane and butane.

15. A burner for powder spray coating to claim 10, said fuel gas selected from the group consisting of propane and butane.

16. A burner for powder spray coating to claim 11, said fuel gas is selected from the group consisting of propane and butane.

* * * * *